United States Patent [19]

Sukenobu

[11] Patent Number: 4,959,544

[45] Date of Patent: Sep. 25, 1990

[54] ENERGY ANALYZER

[75] Inventor: Satoru Sukenobu, Kawasaki, Japan

[73] Assignee: Kabushiki Kaisha Toshiba, Kawasaki, Japan

[21] Appl. No.: 416,455

[22] Filed: Oct. 3, 1989

[30] Foreign Application Priority Data

Oct. 7, 1988 [JP] Japan ..... 63-252976

[51] Int. Cl.[5] ..... H01J 49/48

[52] U.S. Cl. ..... 250/305; 250/310

[58] Field of Search ..... 250/305, 310, 296

[56] References Cited

U.S. PATENT DOCUMENTS

| | | | |
|---|---|---|---|
| 3,170,116 | 2/1965 | Farrington | 250/305 |
| 3,461,306 | 8/1969 | Stout et al. | 250/305 |
| 3,916,190 | 10/1975 | Valentine et al. | 250/305 |
| 3,984,682 | 10/1976 | Matsuda | 250/296 |
| 4,146,787 | 3/1979 | Fite | 250/305 |
| 4,521,687 | 6/1985 | Maito | 250/296 |

OTHER PUBLICATIONS

Oshima et al., "Numerical Calculations of Electron Trajectories in the 127° Analyzer Using a Position-Sensitive Detector Under Conditions of Fringing Fields" Rev. Sci. Instrum. 54 (8), Aug. 1983, pp. 1042-1046.

Siegel et al., "New Wide Angle, High Transmission Energy Analyzer for Secondary Ion Mass Spectrometry" Rev. Sci. Instrum. 52 (11), Nov. 1981, pp. 1603-1615.

*Primary Examiner*—Jack I. Berman
*Assistant Examiner*—Kiet T. Nguyen
*Attorney, Agent, or Firm*—Foley & Lardner, Schwartz, Jeffery, Schwaab, Mack, Blumenthal & Evans

[57] ABSTRACT

An energy analyzer, in which a pair of electrodes forms an electrostatic field for deflection, and entrance and exit aperture plates having an aperture are arranged in entrance and exit portions of the electrostatic field, in which a particle detector is arranged in front of the aperture of the exit aperture plate for detecting a particle passing through the electrostatic field and the apertures of the entrance and exit aperture plates to analyze energy of the particle, and a device controls a voltage distribution of the surface of at least the exit aperture plate to approximately equal to the voltage distribution of the electrostatic field. A velocity analyzer such as a Wien filter is also disclosed, and includes also a device for controlling a voltage distribution of the surfaces of second electrodes to approximately equal to the voltage distribution of the electrostatic field.

10 Claims, 8 Drawing Sheets

ENERGY ANALYZER

BACKGROUND OF THE INVENTION

1. Field of the Invention

The present invention relates to an energy analyzer for use in analyzing energy of charged particles emitted from or reflected by a solid material or the like.

2. Description of the Background Art

In a conventional surface analyzer, an electron beam or ion beam is irradiated onto a surface of a solid specimen, and energy of a particle reflected by or secondary emitted from the surface of the solid specimen is analyzed to measure elementary composition or crystal structure of the solid surface or electronic structure in the solid. In such a surface analyzer, the energy of the particle reflected by or secondary emitted from the solid surface can be accurately analyzed, and requires an energy analyzer having a high analyzing sensitivity.

In FIG. 1, there is shown a conventional 127° energy analyzer 1 of a face-symmetric electrostatic prism type having 127° deflection angle, for use most popularly in various applications. In the energy analyzer 1, a pair of inside and outside electrodes 2 and 3 is arranged in parallel with each other along an arcuate line, and forms an electrostatic field P between themselves. A pair of DC voltage sources 4 and 5 supplies DC voltages to the inside and outside electrodes 2 and 3, respectively. An entrance aperture plate 7 having a hole or aperture 6 in its center is mounted in the entrance side of the electrostatic field P, and an exit aperture plate 9 having a hole of aperture 8 in the center is mounted in the exit side of the electrostatic field P. A particle detector (P.D.) 10 such as a secondary electron multiplier tube is arranged in front of the aperture 8 of the exit plate 9 for catching a particle coming out of the aperture 8 of the exit plate 9. The entrance and exit plates 7 and 9 are usually made of a metallic material such as stainless steels or molybdenum and are held to a zero voltage of an intermediate voltage between the inside and outside electrodes 2 and 3.

The energy analyzer 1 described above is operated in order to analyze particle energy as follows. By using an electron gun 11, an electron beam is irradiated to the surface of a solid specimen 12, and particles such as an electron having a negative charge or the like are emitted from the surface of the solid specimen 12. In order to analyze energy of a particle having a negative charge such as an electron, positive and negative voltages are applied to the inside and outside electrodes 2 and 3, respectively. The particles emitted from the solid specimen 12 are entered the electrostatic field P between the inside and outside electrodes 2 and 3 through the aperture 6 of the entrance plate 7, and the particles are subjected to be deflected by the electrostatic field P. Only a particle or particles having the energy capable of passing through a central orbit of zero voltage can come out of the aperture 8 of the exit plate 9 and come in the particle detector 10. Hence, the presence and amount of such a particle or particles can be detected.

However, in this case, the following problems arise. That is, the entrance and exit plate 7 and 9 are made of a metallic material and are kept at the zero voltage or the intermediate voltage between the inside and outside electrodes 2 and 3. Thus, isoelectric lines 13 are so formed by the inside and outside electrodes 2 and 3 as to surround the inside and outside electrodes 2 and 3, as shown in FIG. 1. As apparent from FIG. 1, the fringing fields between the inside and outside electrodes 2 and 3 and the entrance and exit plates 7 and 9 are largely disturbed, with the result of reducing the energy resolving power. Further, due to the presence of the disturbed fringing fields, the exit plate 9 can be provided with only one aperture on the beam central orbit in the central portion of the exit plate 9. As a result, plural energy analyses can not be effected at the same time.

In FIGS. 2 to 4, there is shown conventional velocity analyzer, such as a Wien filter for use in a mass separation of charged particles or the like. In a conventional ion radiation system, an ion beam is irradiated to the surface of a solid specimen to carry out an ion implantation into the specimen or an improvement of the quality of the specimen surface, or an analysis of the specimen surface is effected by analyzing the particle or particles emitted from or reflected by the surface of the specimen. In this case, in order to increase the purity of the radiating ion, an ion mass separator is used in an ion beam transfer system. This ion mass separator is basically an ion velocity separator or selector. A sector magnet or a Wien filter is known as an ion mass separator. Since the Wien filter has a simple structure and is used without bending the ion beam, thus it can be applied in various ion irradiation apparatuses. The Wien filter is also called as an E x B mass separator, and effects an ion velocity separation by a uniform electrostatic field and a uniform magnetic field crossing each other at right angles.

As shown in FIG. 2, the Wien filter comprises a pair of magnet 33 arranged in parallel in opposite sides, for forming magnetic flux 32 in the direction perpendicular to a moving direction 31 of an ion coming into the Wien filter, and a pair of electrodes 35*a* and 35*b* arranged in parallel in opposite sides, for giving an electric field in the direction perpendicular to the the moving direction 31 and the magnetic flux 32.

In this case, when an ion is entered the Wien filter, an ion having a velocity Vo satisfying a formula $Vo=E/B$, wherein E is an intensity of an electric field and B is a magnetic flux density, can go straight on in a space surrounded by the magnets 33 and the electrodes 35*a* and 35*b* without receiving any deflection. However, ions having a velocity except the velocity Vo are bent in the direction of the electric field 34 in FIG. 2, thereby effecting the ion velocity separation. In this case, when ions having the same energy are radiated from an ion source, the mass of the ions is separated.

In this Wien filter, the pair of magnets 33 are composed of a metallic material and are held to the zero voltage of an intermediate voltage between the electrodes 35*a* and 35*b*. Accordingly, isoelectric lines 36 in the space within the Wien filter are bent and disturbed, as shown in FIG. 3. Within the space surrounded by the magnets 33 and the electrodes 35*a* and 35*b*, the electric field directing perpendicular to the moving direction 31 of the ion and the magnetic flux 32 is given in the vertical center between the electrodes 35*a* and 35*b*. However, the electric field directing from the electrodes 35*a* and 35*b* to the magnets 33 is formed in the magnet sides, which is contrary to the condition such as a uniform electrostatic field required to the Wien filter, resulting in lowering the mass resolving power.

In order to avoid this problem, a pair of electrodes 35*c* and 35*d* having a U-shape longitudinal cross section is provided instead of the straight electrodes 35*a* and 35*b* to obtain a uniform electric field, as shown in FIG.

4. However, in this case, the uniform electric field portion or space is reduced, and hence the entire space within the Wien filter can not be effecitvely and advantageously utilized. Furthermore, there is a possibility or risk of bringing about enlarging of the whole system.

SUMMARY OF THE INVENTION

Therefore, it is an object of the present invention to provide an energy analyzer, free from the aforementioned defects and disadvantages of the prior art, which is capable of largely improving energy resolving power, effecting plural energy analysis at the same time and minimizing the size of the energy analyzer.

It is another object of the present invention to provide a velocity analyzer, free from the aforementioned defects and disadvantages of the prior art, which is capable of largely improving energy resolving power and minimizing the size of the energy analyzer.

In accordance with one aspect of the present invention, there is provided an energy analyzer, comprising a pair of electrodes for forming an electrostatic field for deflection, entrance and exit aperture plates having an aperture, arranged in entrance and exit portions of the electrostatic field, a particle detector arranged in front of the aperture of the exit aperture plate for detecting a particle passing through the electrostatic field and the apertures of the entrance and exit aperture plates to analyze energy of the particle, and means for controlling a voltage distribution of a surface of at least the exit aperture plate to approximately equal to a voltage distribution of the electrostatic field.

In accordance with another aspect of the present invention, there is provided a velocty analyzer, comprising, a pair of magnets arranged in parallel in upper and lower sides to form magnetic flux between the magnets, a pair of first electrodes arranged in parallel in left and right sides between the magnets, the first electrodes extending approximately perpendicular skew to the magnets to give an electrostatic field for deflection, located perpendicular to the magnetic flux, a pair of second electrodes arranged in parallel between the first electrodes, the second electrodes extending in parallel with the magnets, and means for controlling a voltage distribution of surfaces of the second electrodes to approximately equal to a voltage distribution of the electrostatic field.

BRIEF DESCRIPTION OF THE DRAWINGS

The above and other objects, features and advantages of the present invention will more fully appear from the following description of the preferred embodiments with reference to the accompaying drawings, in which.

DESCRIPTION OF THE PREFERRED EMBODIMENTS

Figure 1:
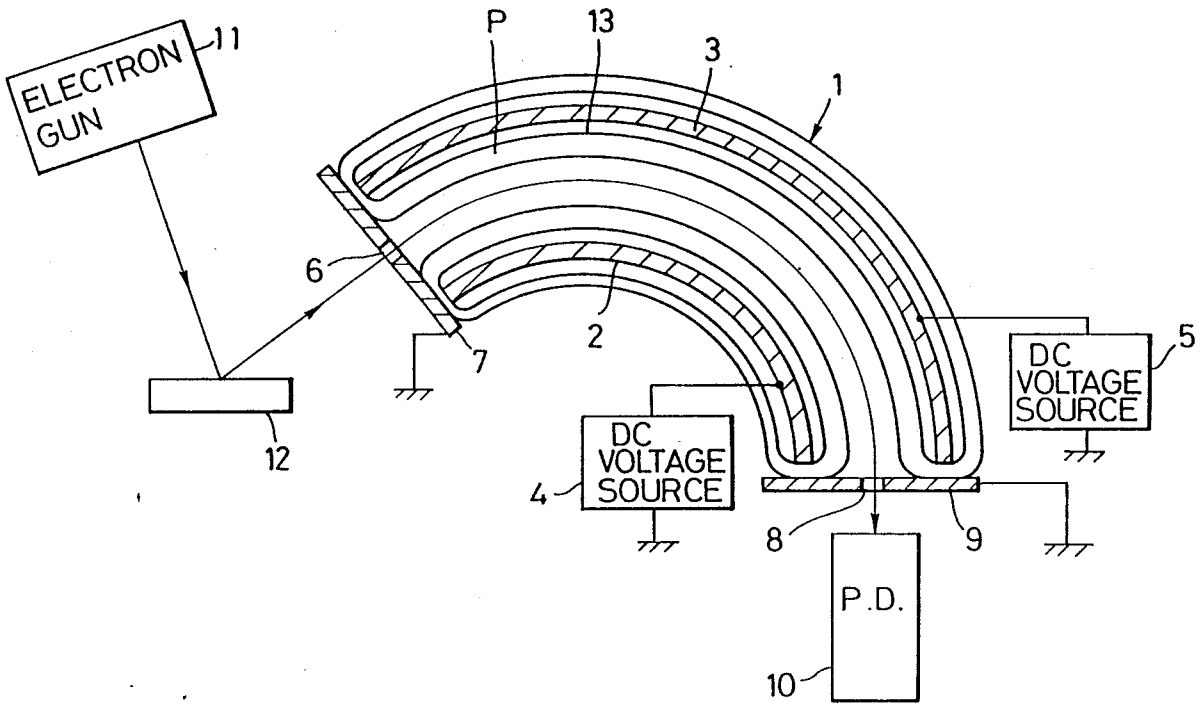
FIG. 1 PRIOR ART
FIG. 1 is a schematic block diagram of a conventional energy analyzer.
Figure 2:
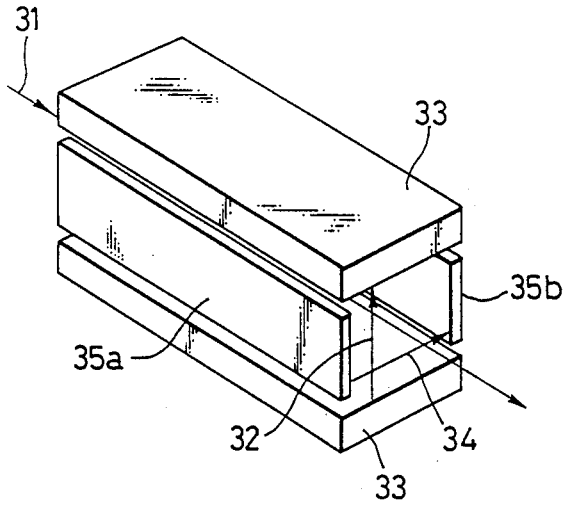
FIG. 2 PRIOR ART
FIG. 2 is a perspective view of a conventional Wien filter.
Figure 3:
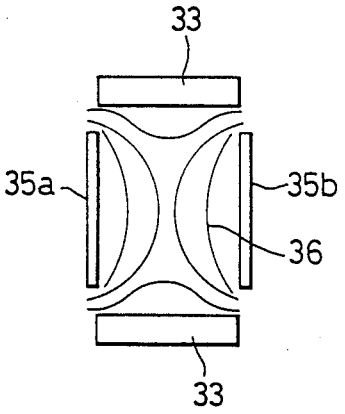
FIG. 3 PRIOR ART
FIGS. 3 and 4 are schematic explanatory views showing isoelectric distributions within conventional Wien filters.
Figure 4:
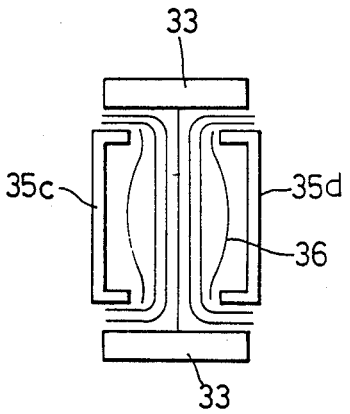
FIG. 4 PRIOR ART
Figure 5:
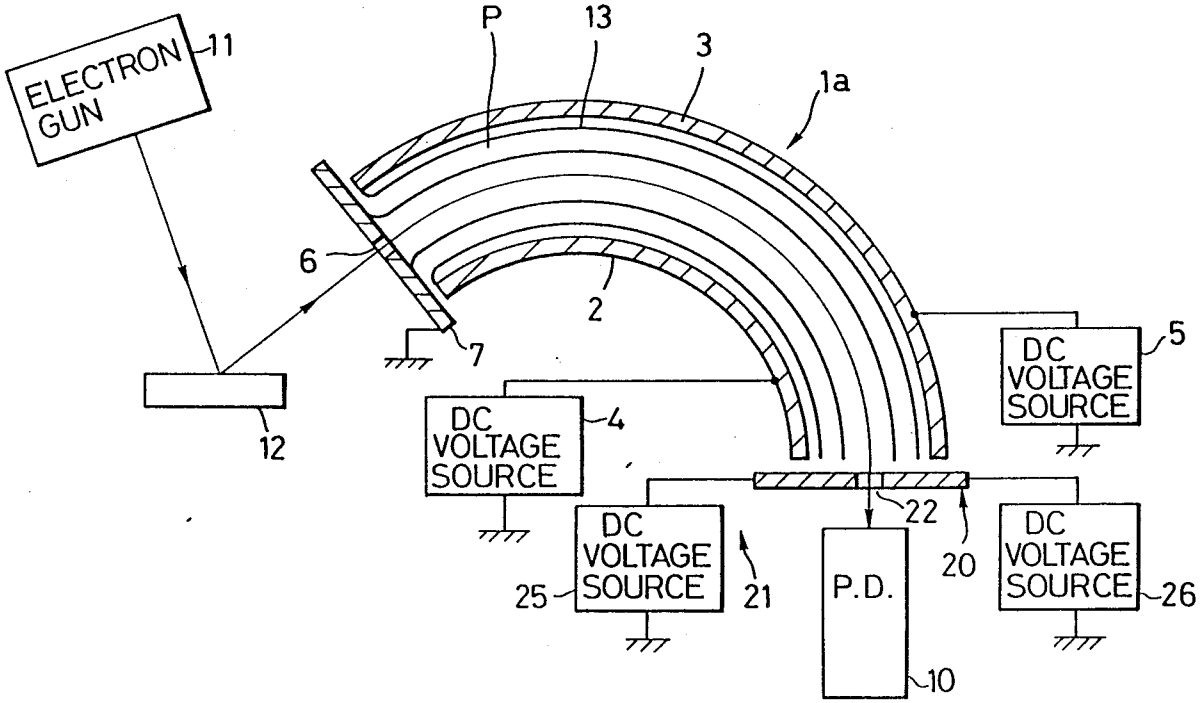
FIG. 5 is a schematic block diagram of one embodiment of an energy analyzer according to the present invention.

Referring now to the drawings, wherein like reference characters designate like or corresponding members throughout the several views, there is shown in FIG. 5 the first embodiment of a 127° energy analyzer of a face-symmetric electrostatic prism type having 127° deflection angle according to the present invention.

As shown in FIG. 5, the energy analyzer 1*a*, a pair of inside and outside electrodes 2 and 3 is arranged in parallel with each other along an arcuate line, and forms an electrostatic field P for deflection between themselves. A pair of DC voltage sources 4 and 5 supplies DC voltages to the inside and outside electrodes 2 and 3, respectively, the DC voltage sources 4 and 5 constituting a first DC voltage supply system. An entrance aperture plate 7 having a hole or aperture 6 in its center is mounted in the entrance side of the electrostatic field P and is composed of a metallic material such as a stainless steel or molybdenum and is held to a zero voltage or an intermediate voltage between the inside and outside electrodes 2 and 3. An exit aperture plate 20 having a hole of aperture 22 in the center, which is hereinafter described in detail, is mounted in the exit side of the electrostatic field P. A particle detector (P.D.) 10 such as a secondary electron multiplier tube is arranged in front of the aperture 22 of the exit plate 20 for catching a particle coming out of the aperture 22 of the exit plate 20.

When the energy analyzer 1*a* is operated in order to analyze particle energy, an electron beam is irradiated to a surface of a solid specimen 12 by using an electron gun 11 in the same manner as the conventional one described above. Particles such as an electron having a negative charge or the like emitted from the surface of the solid specimen 12 are entered the electrostatic field P between the inside and outside electrodes 2 and 3 through the aperture 6 of the entrance plate 7, and a part of the particles may pass through the electrostatic field P, and come out through the aperture 22 of the exit plate 20 to come in the particle detector 10. Hence, the presence and amount of such a particle or particles can be detected.

Figure 6:
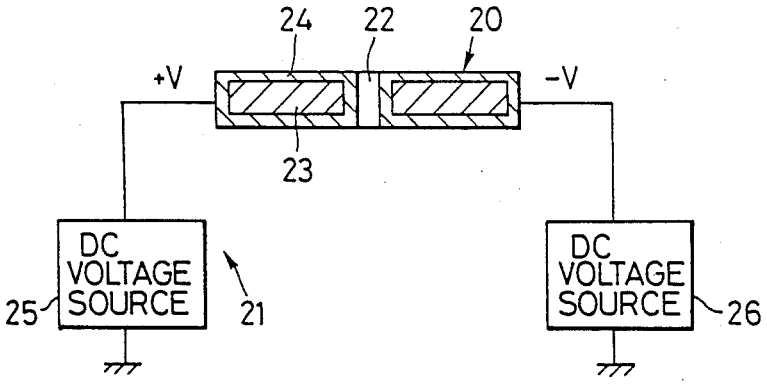
FIG. 6 is an enlarged horizontal cross section of one embodiment of an exit aperture plate shown in FIG. 5.

In FIG. 6, there is shown one embodiment of the exit aperture plate 20 which comprises a plate member 23 having an aperture in its center, composed of an insulating material such as alumina, and a conductor film layer 24 formed over the entire surface of the plate member 23 by coating or using an adhesive or the like, the conductor film layer 24 having a thickness of several 10 μm and a specific electrical resistaance of $10^{-5}$ Ωcm to $10^{2}$ Ωcm.

A second DC voltage supply system 21 includes a pair of DC voltage sources 25 and 26 for supplying DC voltages to the side ends of the exit plate 20, the side ends being located along the side extending in the direction of the voltage slope in the electrostatic field P. The DC voltages supplied from the DC voltage sources 25 and 26 to the conductor film layer 24 at the side ends of the exit plate 20 are so controlled or determined that the surface voltage distribution of the exit plate 20 may be equal to the voltage distribution in the electrostatic field P.

In this embodiment, the electrical resistance of the conductor film layer 24 of the exit plate 20 is varied linearly in the direction of the voltage slope in the electrostatic field P. Hence, when certain DC voltages are supplied from the DC voltage sources 25 and 26 to the conductor film layer 24 at the side ends of the exit plate 20, the surface voltage of the conductor film layer 24, i.e., the exit plate 20 changes linearly in the direction of the voltage slope in the electrostatic field or from the left hand side to the right hand side in FIG. 5.

Thus, when positive and negative DC voltages are supplied to the inside and outside electrodes 2 and 3, respectively, to carry out the energy analyses, the voltages of the respective DC voltage source 25 and 26 are determined to certain positive and negative DC voltages, respectively, to make the surface voltage distribution of the exit plate 20 to be coincide with the spatial voltage distribution in the electrostatic field P between the inside and outside electrodes 2 and 3. As a result, the isoelectric lines 13 intersect the surface of the exit plate 20 at right angle, as shown in FIG. 5, thereby preventing the disturbance of the fringing fields between the exit plate 20 and the inside and outside electrodes 2 and 3 and thus largely and effectively improving the energy resolving power.

Figure 7:
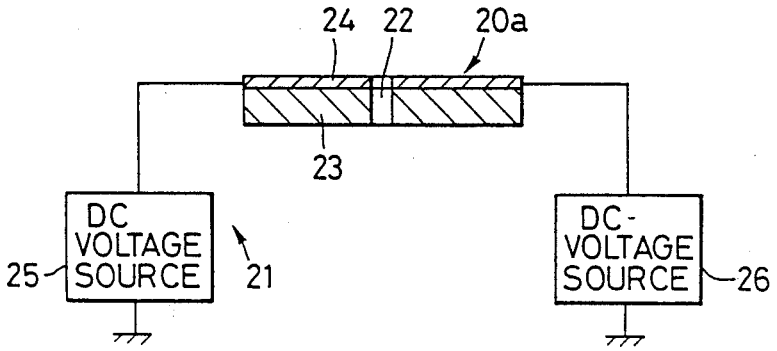
FIG. 7 is an enlarged horizontal cross section of another embodiment of the exit aperture plate shown in FIG. 5.

In FIG. 7, there is shown another embodiment of an exit aperture plate 20*a* comprising a plate member 23 having an aperture in the center, composed of the insulating material, and a conductor film layer 24 formed on one surface of the plate member 23 in the same manner as the embodiment shown in FIG. 6, the one surface of the plate member 23 or the exit aperture plate 20*a*, facing the electrostatic field P. In this embodiment, the same effects and advantages as those of the exit aperture plate 20 shown in FIG. 6 can be obtained.

Figure 8:
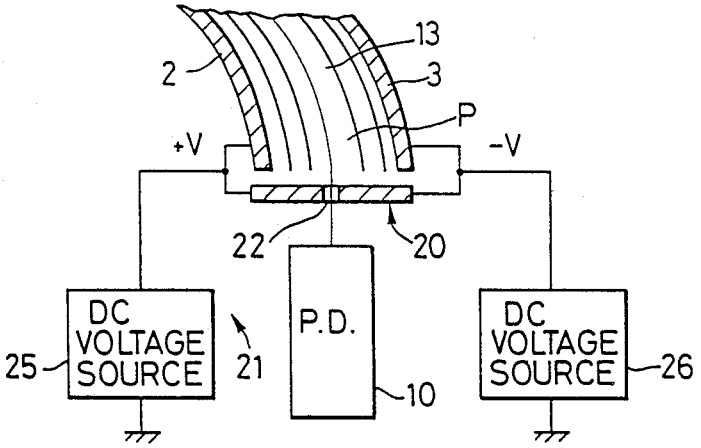
FIG. 8 is a fragmentary schematic block diagram of another embodiment of a DC voltage supply system of an energy analyzer according to the present invention.

In FIG. 8, there is shown another DC voltage supply system of the energy analyzer according to the present invention. In this case, the DC voltage sources 4 and 5 of the first DC voltage supply system are not provided. But, a pair of DC voltage sources 25 and 26 of the second DC voltage supply system 21 commonly supplies the DC voltages to the inside and outside electrodes 2 and 3 and to the side ends of the exit plate 20, respectively. In this embodiment, the same effects and advantages as those of the first embodiment shown in FIG. 5 can be obtained.

Figure 9:
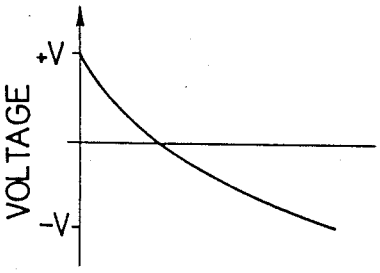
FIG. 9 is a graphical representation of a surface voltage distribution of an exit aperture plate to be used in an energy analyzer according to the present invention.
Figure 10:
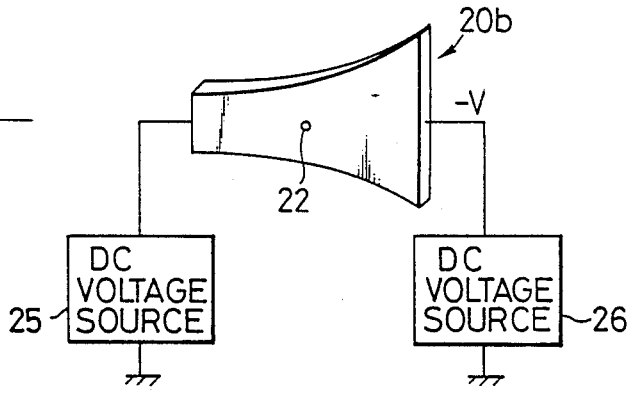
FIG. 10 is a schematic perspective view of another exit aperture plate for obtaining the surface voltage distribution shown in FIG. 9.

Further, in order to control or determine the voltage distribution of the surface of the exit plate 20, as shown in FIG. 9, a shape such as width of an exit plate 20*b* may be changed so as to gradually increase in the right hand side direction, i.e., the direction of the voltage decrease in the voltage slope, as shown in FIG. 10, and, alternatively, the thickness of the conductor film layer 24 of the exit plate 20 may be changed so as to gradually increase in the same manner.

Figure 11:
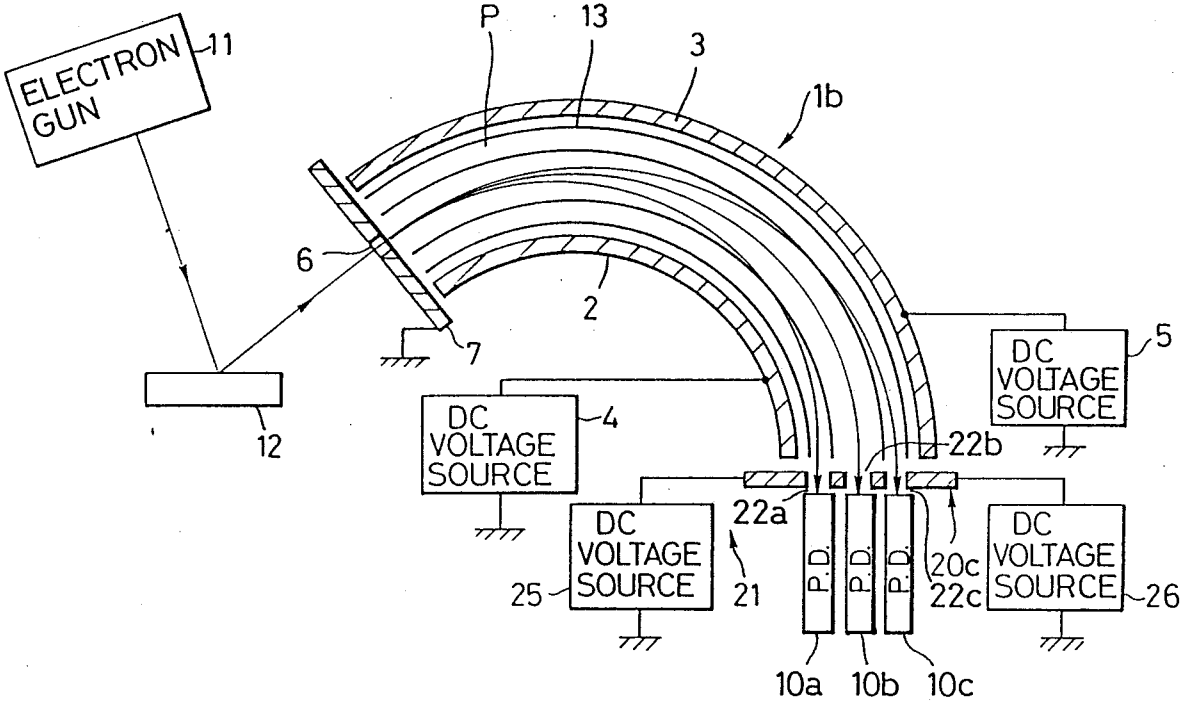
FIG. 11 is a schematic block diagram of another embodiment of an energy analyzer which is capable of performing plural energy analysis according to the present invention.

In FIG. 11, there is shown another embodiment of an energy analyzer 1*b* according to the present invention, having a similar construction to the first embodiment shown in FIG. 5.

Figure 12:
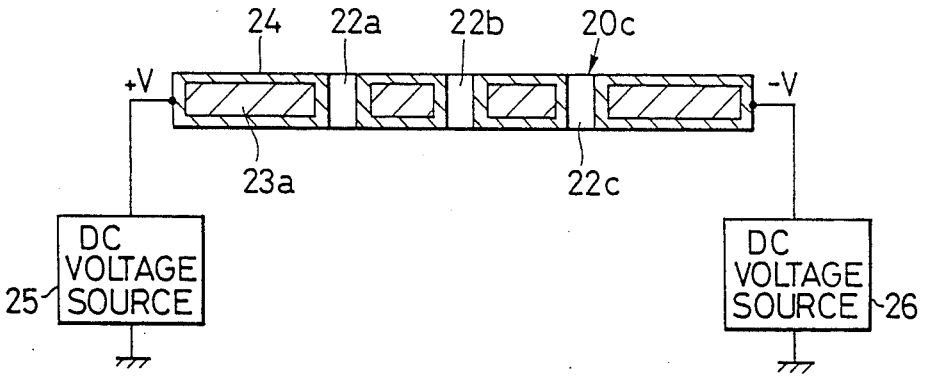
FIG. 12 is an enlarged horizontal cross section of one embodiment of an exit aperture plate shown in FIG. 11.

In this embodiment, as shown in FIG. 12, an exit aperture plate 20*c* comprises a plate member 23*a* having three apertures 22*a*, 22*b* and 22*c* aligned in series in the direction of the voltage slope in the electrostatic field P, and a conductor film layer 24 formed over the entire surface of the plate member 23*a* in the same manner as that of the first embodiment. The plate member 23*a* and the conductor film layer 24 are made of the same materials as those of the first embodiment. Three particle detectors (P.D.) 10*a*, 10*b* and 10*c* are aligned in series in front of the respective apertures 22*a*, 22*b* and 22*c* of the plate member 23*a* for catching particles to be discharged therefrom.

In this embodiment, the DC voltages are supplied from the DC voltage sources 25 and 26 to the side ends of the exit plate 20*c* so that the surface voltage distribution of the exit plate 20*c* may be equal to the spatial voltage distribution in the electrostatic field P in the same manner as the first embodiment, Hence, the disturbance of the fringing fields between the exit plate 20*c* and the inside and outside electrodes 2 and 3 are prevented, and the energy resolving power can be effectively improved in the same manner as the first embodiment described above. Further, a plurality of apertures can be provided with the exit aperture plate to effect plural energy analysis at the same time in one energy analyzer.

Figure 13:
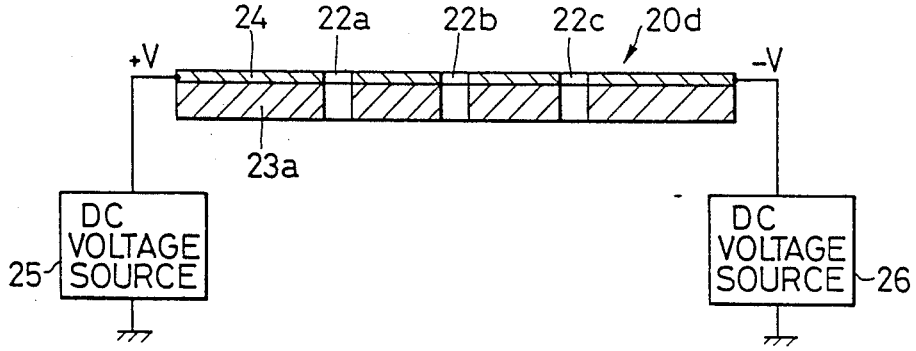
FIG. 13 is an enlarged horizontal cross section of another embodiment of the exit aperture plate shown in FIG. 11.

In FIG. 13, there is shown another embodiment of an exit aperture plate 20*d* having three apertures 22*a*, 22*b* and 22*c*, having the same structure as the embodiment shown in FIG. 7, except the number of the aperture. In this case, the same effects and advantages as those of the embodiment shown in FIG. 12 can be obtained.

According to the present invention, any plate with an aperture or apertures, having an insulating property may be used as an exit aperture plate. For instance, meshes or nets having an insulating property may be used. Further, the present invention can be applied to the entrance aperture plate 7. That is, an entrance aperture plate 7 having the same structure as the plates shown in FIGS. 6 and 7 can be used, and the DC voltages are supplied from the DC voltage sources to the side ends of the plate 7 so that the surface voltage distribution of the exit plate 20*c* may be equal to the spatial voltage distribution in the electrostatic field P.

According to the present invention, the essential concept described above, that is, the voltage distribution of the surface of the aperture plate is controlled to be approximately equal to the voltage distribution of the electrostatic field to prevent the disturbance of the fringing fields between the electrodes and the aperture plate, is also applicable to a Wien filter which is a velocity analyzer for use in effecting mass separation of charged particles or the like.

Figure 14:
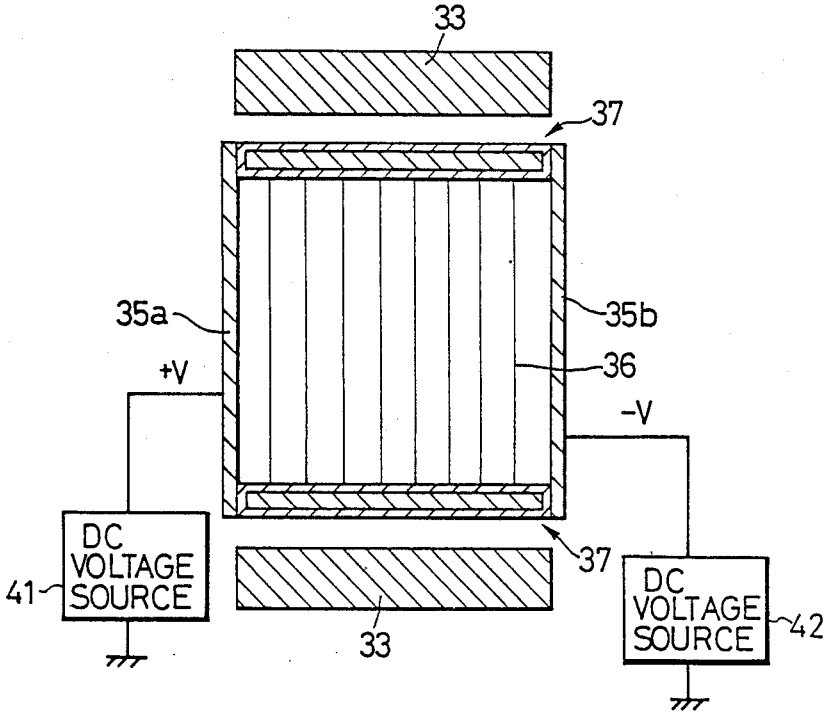
FIG. 14 is a vertical cross section of one embodiment of a Wien filter according to the present invention.

In FIG. 14, there is shown a velocity analyzer such as a Wien filter, according to the present invention.

A pair of magnets 33 are arranged in parallel with each other in the upper and lower sides to form magnetic flux between the magnets 33. A pair of first electrodes 35*a* and 35*b* extends perpendicular skew to the magnets 33 and is arranged in parallel with each other in the left and right sides between the magnets 33 separate therefrom to give an electric field in the direction perpendicular to the magnetic flux and a moving direction, perpendicular to the plane of the drawing sheet, of an ion coming into the Wien filter. A pair of second electrodes 37 extends in parallel with the magnets 33 and is arranged in parallel with each other between the first electrodes 35*a* and 35*b* in contact with the upper and lower ends thereof. Hence, the first and second electrodes 35*a*, 35*b* and 37 constitute a rectangular tube form.

Figure 15:
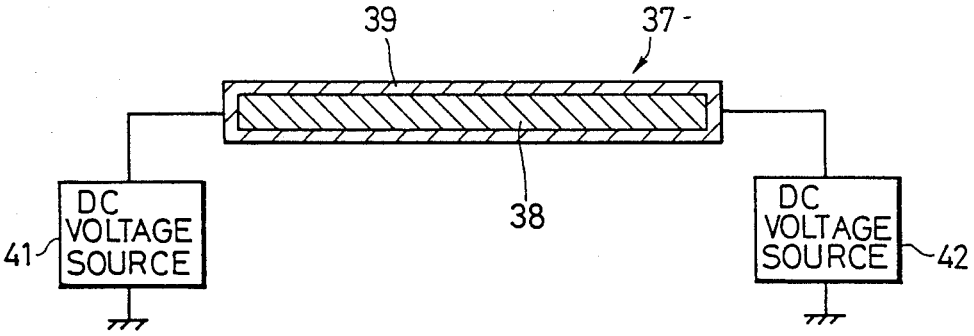
FIG. 15 is an enlarged vertical cross section of a second electrode plate used in the Wien filter shown in FIG. 14.

As shown in FIG. 15, each second electrode 37 comprises an insulating base plate 38 composed of an insulating material such as alumina, and a conductor film layer 39 formed over the entire surface of the base plate 38 by coating or using an adhesive or the like, the conductor film 38 having a thickness of several 10 μm and a specific electrical resistance varying from $10^{-5}$ Ωcm at one side-end to $10^{2}$ Ωcm at the other side end of the second electrode 37. In this embodiment, the electrical resistance of the conductor film layer 38 of the second electrode 37 is changed linearly corresponding to the voltage slope in the electrostatic field between the first electrodes 35*a* and 35*b*. Hence, when certain DC voltages are supplied from DC voltage sources 41 and 42 to the second electrode 37 at the side ends, the surface voltage of the second electrodes 37 changes linearly in the direction of the voltage slope in the electrostatic field or from the right or left hand side to the left or right hand side in FIG. 15.

Thus, when positive and negative DC voltages are supplied to the first electrodes 35*a* and 35*b*, respectively, to carry out an energy analysis such as a mass separation of charged particles, the voltages of the respective DC voltage source 41 and 42 are determined to certain positive and negative DC voltages, respectively, so as to make the surface voltage distribution of the second electrodes 37 to be coincide with the spatical voltage distribution in the electrostatic field between the first electrodes 35*a* and 35*b*.

That is, the DC voltages are supplied from the DC voltage sources 41 and 42 to the conductor film layers 38 at the side ends of the second electrode 37 so that the surface voltage distributions of the second electrodes 37 may be equal to the voltage distribution of the spatial electrostatic field within the Wien filter. As a result, in the Wien filter, isoelectric lines 36 intersect the surfaces of the second electrodes 37 at right angles, as shown in FIG. 14, thereby obtaining a uniform electrostatic field between the first electrodes 35*a* and 35*b*, preventing the disturbance of the internal peripheral fields between the magnets or the electrodes and thus largely and effectively improving the mass resolving power. Hence, the whole space within the Wien filter can be effectively and advantageously utilized, and the size of the Wien filter can be minimized.

In this embodiment, the DC voltages may be supplied to the second electrodes 37 directly or via the first electrodes 35*a* and 35*b*. The conductor film layer 39 may be formed on at least the inside surfaces of the second electrodes 37, the inside surfaces facing the spatial electrostatic file within the Wien filter, in the same manner as the embodiments shown in FIGS. 7 and 13.

Although the present inventon has been described in its preferred embodiments with reference to the accompanying drawings, it is readily understood that the present invention is not restricted to the above described preferred embodiments, and various changes and modificatons may be made in the present invention by those skilled in the art without departing from the spirit and scope of the present invention.

What is claimed is:

1. An energy analyzer, comprising:

a pair of electrodes for forming an electrostatic field for deflection;

entrance and exit aperture plates having an aperture, arranged in entrance and exit portions of the electrostatic field;

a particle detector arranged in front of the aperture of the exit aperture plate for detecting a particle passing through the electrostatic field and the apertures of the entrance and exit aperture plates to analyze energy of the particle; and means connected to the sides of at least the exit aperture plate for controlling a voltage distribution of a surface of at least the exit aperture plate to approximately equal to a voltage distribution of the electrostatic field.

2. The analyzer of claim 1, also including first means for supplying DC voltages to the electrodes.

3. The analyzer of claim 1, wherein the controlling means includes:

the aperture plate comprising an insulating plate member and a conductor layer having a specific electrical resistance of $10^{-5}$ Ωcm to $10^{2}$ Ωcm, formed on at least one surface of the insulating plate member, the one surface facing the electrostatic field; and second means for supplying DC voltages to the aperture plate at side ends thereof.

4. The analyzer of claim 1, wherein the exit aperture plate including a plurality of apertures aligned in a direction of a voltage slope in the electrostatic field, and a plurality of particle detectors are arranged in front of the apertures.

5. The analyzer of claim 3, wherein the conductor layer has a thickness of approximately several 10 μm.

6. The analyzer of claim 3, wherein an electrical resistance of the conductor layer is varied linearly in a direction of a voltage slope in the electrostatic field.

7. A charged particle velocity analyzer, comprising:

a pair of magnets arranged in parallel in upper and lower sides to form magnetic flux between the magnets;

a pair of first electrodes arranged in parallel in left and right sides between the magnets, the first electrodes extending approximately perpendicular skew to the magnets to give an electrostatic field for deflection, located perpendicular to the magnetic flux;

a pair of second electrodes arranged in parallel between the first electrodes, the second electrodes extending in parallel with the magnets; and means for controlling a voltage distribution of surfaces of the second electrodes to approximately equal to a voltage distribution of the electrostatic field.

8. The analyzer of claim 7, wherein the controlling means includes:

the second electrodes each comprising an insulating plate member and a conductor layer having a specific electrical resistance of $10^{-5}$ Ωcm to $10^{2}$ Ωcm, formed on at least one surface of the insulating plate member, the one surface facing the electrostatic field; and means for supplying DC voltages to the second electrodes at side ends thereof.

9. The analyzer of claim 8, wherein the conductor layer has a thickness of approximately several 10 μm.

10. The analyzer of claim 8, wherein an electrical resistance of the conductor layer is varied linearly in a direction of a voltage slope in the electrostatic field.

* * * * *